US006840151B1

(12) United States Patent
Barker et al.

(10) Patent No.: US 6,840,151 B1
(45) Date of Patent: Jan. 11, 2005

(54) MOTOR

(75) Inventors: Fred B. Barker, Scottsdale, AZ (US); George Konrad, Glendale, AZ (US)

(73) Assignee: PowerVerde, LLC, Phoenix, AZ (US)

( * ) Notice: Subject to any disclaimer, the term of this patent is extended or adjusted under 35 U.S.C. 154(b) by 89 days.

(21) Appl. No.: 10/410,758

(22) Filed: Apr. 10, 2003

(51) Int. Cl.[7] ..... F01B 1/00
(52) U.S. Cl. ..... 91/485; 91/498; 92/72
(58) Field of Search ..... 91/485, 491, 498; 92/72, 140

(56) References Cited

U.S. PATENT DOCUMENTS 546,055 A * 9/1895 Pitt ..... 91/493
759,828 A * 5/1904 Olney ..... 91/493
780,640 A * 1/1905 Conway ..... 91/493
2,091,912 A * 8/1937 De Lancey ..... 92/72
2,147,666 A * 2/1939 Park ..... 91/493
3,583,286 A * 6/1971 Chiappulini ..... 91/491
4,106,391 A 8/1978 Wheeler ..... 91/481
5,094,106 A * 3/1992 Dedisse et al. ..... 73/247
5,811,676 A * 9/1998 Spalding et al. ..... 92/140

* cited by examiner

*Primary Examiner*—Edward K. Look
*Assistant Examiner*—Michael Leslie
(74) *Attorney, Agent, or Firm*—Cahill, von Hellens & Glazer P.L.C.

(57) ABSTRACT

A push-push type fluid pressure actuated motor has one or more radial opposed cylinder sets each having a pair of pistons, a connecting rod, and a Scotch-yoke connection to a crankshaft. An intake rotor valve at one face of the cylinder block and an exhaust rotor valve at an opposite face of the cylinder block are mounted on and rotate with the crankshaft. The rotor valves admit pressurized fluid to the cylinder and allow discharge of spent fluid from the cylinders.

4 Claims, 3 Drawing Sheets

MOTOR

TECHNICAL FIELD

This invention is directed to improvements in fluid pressure actuated motors.

BACKGROUND ART

There are many applications for a motor operating on a pressurized fluid. That fluid may, for example, be air, natural gas, carbon dioxide or a vaporizable liquid in an Organic Rankine Cycle system.

Particularly suited for many such applications is the, so called, "push-push" radial reciprocating motor. This type of motor has a set of two opposed cylinders with a crankshaft midway between the cylinders. Pistons in the cylinders are connected to the crankshaft by a common connecting rod having a Scotch yoke engaging the crank pin. A valving arrangement driven by the crankshaft directs pressurized fluid to the top of one piston and to the bottom of the other during a half revolution of the crankshaft. During the succeeding half revolution of the crankshaft pressurized fluid is directed to the top of the other piston and the bottom of the one piston. Thus, the crankshaft is propelled throughout each revolution creating a powerful torque.

U.S. Pat. No. 4,106,391 granted Aug. 15, 1978 to Roland T. Wheeler for "Motor" discloses a four cylinder radial push-push motor. That motor employs a fairly complex valve actuating mechanism including linkages between the valves for one set of cylinders and the Scotch yoke of the other set of cylinders.

There continues to be a need for a simplified and reliable push-push motor.

DISCLOSURE OF THE INVENTION

The motor of this invention includes a cylinder block having at least one, and preferably three sets of opposed cylinders therein. The cylinder block has a crankshaft therein driven by pistons in the cylinders. The crankshaft has portions extending beyond an intake face of the block and an exhaust face of the block. There is an intake rotor valve at the intake face of the block and which is mounted on and rotatable with the crankshaft. There is an exhaust rotor valve at the exhaust face of the block and which is also mounted on and rotatable with the crankshaft.

These two rotor valves cooperate to sequentially and cyclically admit pressurized fluid to the cylinders and exhaust spent fluid from the cylinders so that the pistons in the cylinders are propelled in the push-push sequence described above.

BRIEF DESCRIPTION OF THE DRAWINGS

The invention is described in greater detail hereinafter by reference to the accompanying drawings wherein.

BEST MODES FOR CARRYING OUT THE INVENTION

Figure 1:
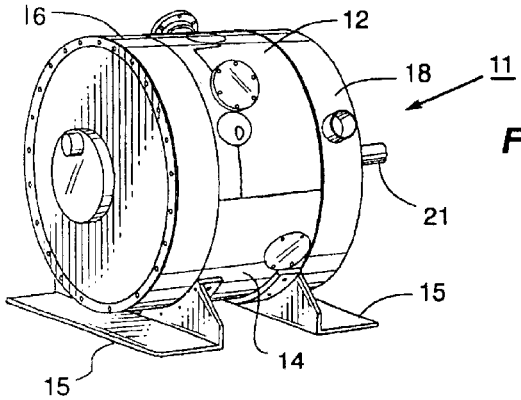
FIG. 1 is an isometric view of a motor constructed in accordance with this invention.

In FIG. 1 reference numeral 11 designates generally a fluid pressure actuated motor employing this invention. The motor 11 has a split two-piece cylinder block 12 having an upper portion 13 and a lower portion 14. The motor may have feet 15 attached to the cylinder block lower portion 14 for mounting the motor.

Figure 2:
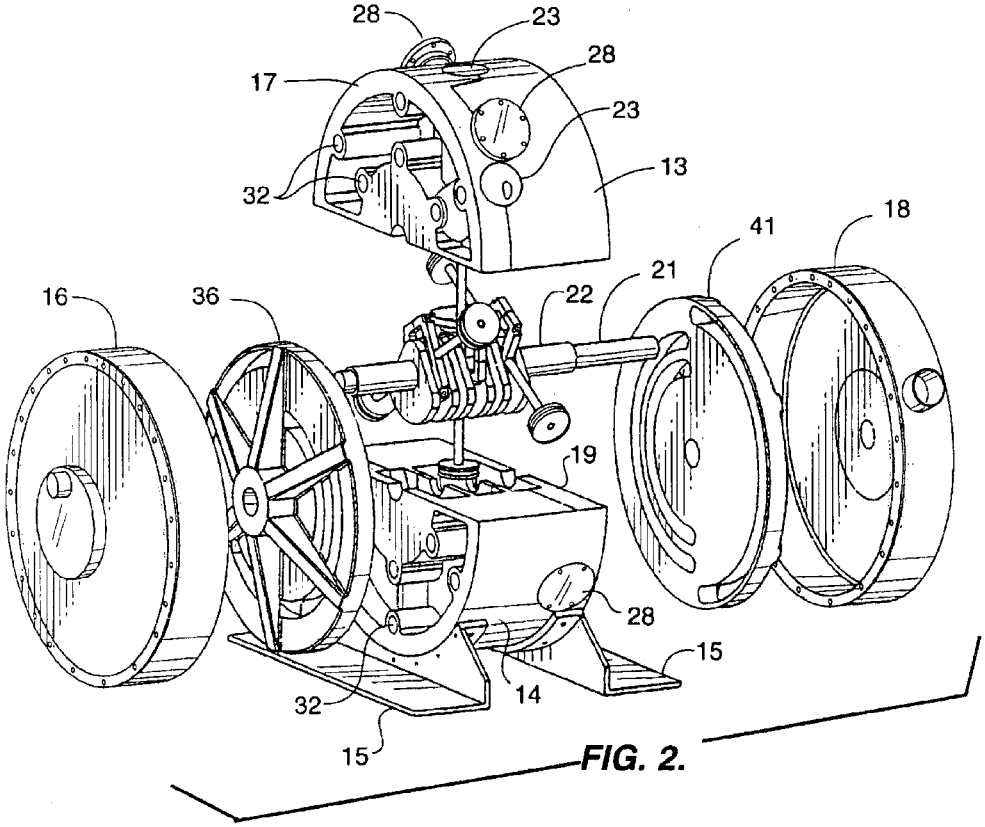
FIG. 2 is an exploded isometric view of the motor of FIG. 1.
Figure 3:
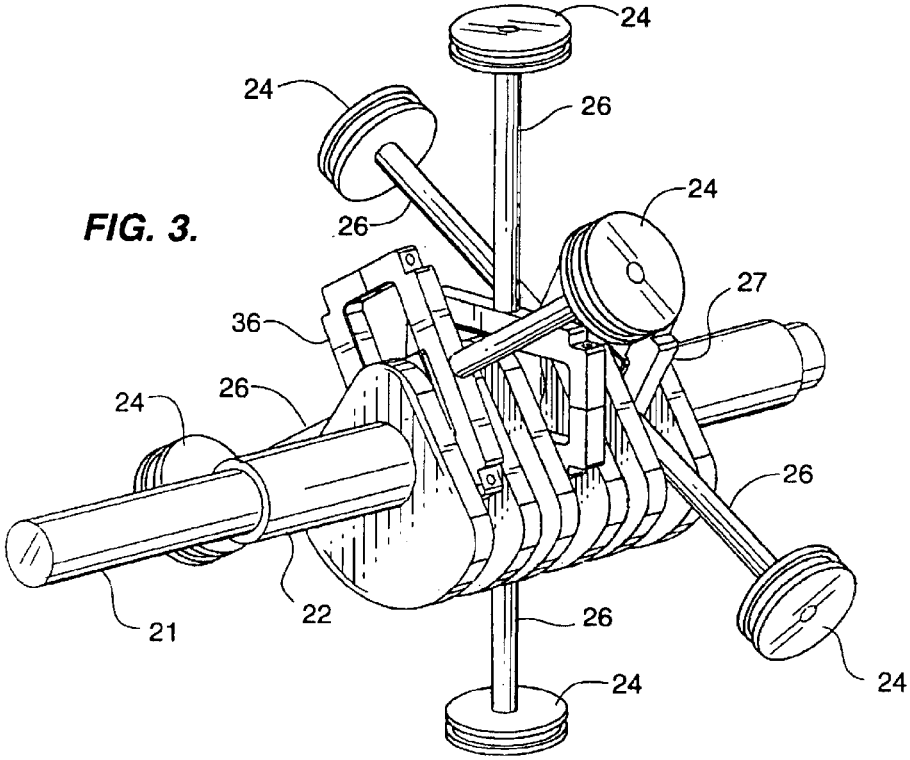
FIG. 3 is an enlarged isometric view of the crankshaft and piston assemblage of the motor taken from a different point of view.

As best shown in FIGS. 1 and 2 the motor 11 further comprises an intake cover 16 over the intake face 17 of cylinder block 12 and an exhaust cover 18 over the exhaust face 19 of the cylinder block.

Protruding from one end of the motor 11 is a drive portion 21 of a crankshaft 22 axially positioned for rotation within cylinder block 12. Drive portion 21 of the crankshaft is adapted to be coupled to another appliance, such as a generator, for driving the latter.

Although the principles of this invention are applicable to a fluid pressure motor having but one set of opposed cylinders multiple sets are preferred to increase the output of the motor. In the embodiment illustrated and preferred three sets of opposed cylinders are employed. Each cylinder set consists of one cylinder 23 in the upper portion 13 of cylinder block 12 and an opposed identical cylinder 23 in the lower portion 14 of cylinder block 12. The three cylinder sets are spaced axially in the cylinder block 12 and radially spaced 120° apart.

Figure 6:
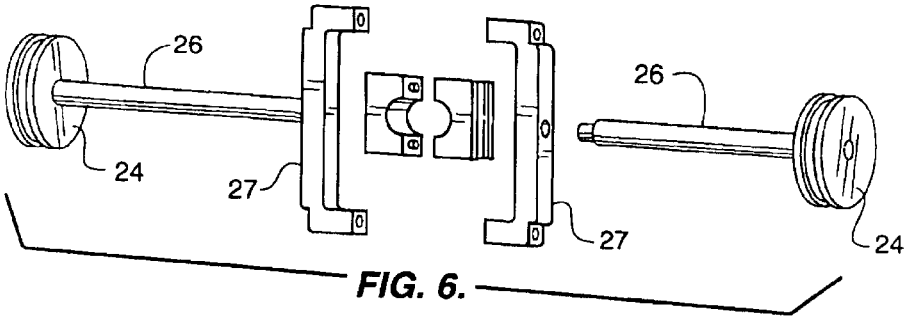
FIG. 6 is an exploded view of the piston-connecting rod-Scotch yoke assembly employed in the motor.

Disposed in each set of cylinders 23 are two pistons 24, one for each cylinder. The two pistons 24 of each set of cylinders 23 are connected by a connecting rod 26 having a Scotch yoke connection 27 midway between the pistons for embracing a crank pin of the crankshaft 22. Construction of the piston/connecting rod assembly is illustrated in FIG. 6.

Each cylinder 23 is closed at its outer end with a plug 28 and at its inner end by another plug 29 having a seal 31 engaging the connecting rod 26.

The cylinder block 12 further has provided therein a pair of intake ports 32 extending from the intake face 17 of the block to opposite end regions of each cylinder 23. The block also has formed therein two exhaust ports 33 extending from opposite end regions of each cylinder to the exhaust face 19 of the block.

Figure 4:
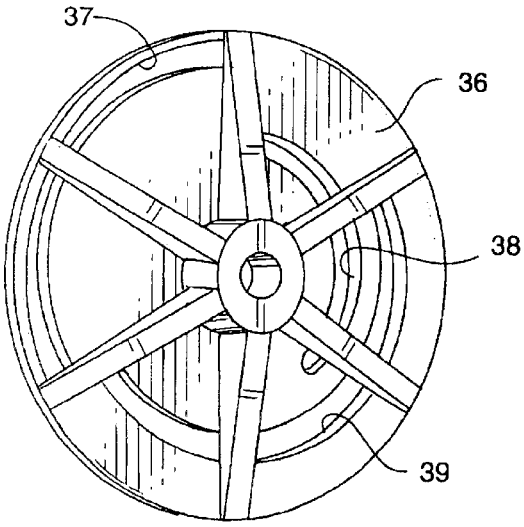
FIG. 4 is a view of the outer face of an intake rotor valve employed in the motor.

The admission of pressurized fluid to the cylinders 23 is under control of an intake rotor valve 36 at the intake face 17 of the cylinder block. Intake valve 36 is mounted on and rotatable with an extension of crankshaft 22. As best shown in FIG. 4, intake rotor valve 36 has an outer arcuate slot 37 positioned to overlie the intake ports 32 communicating with the outer ends of cylinders 23. The intake rotor valve also has a second arcuate slot 38 positioned to overlie the intake ports 32 communicating with the inner ends of the cylinders 23. If desired the valve 36 may have another slot 39 provided therein to balance the valve.

Figure 5:
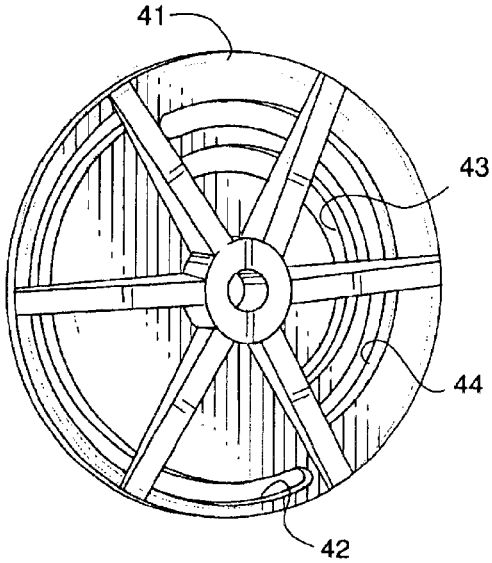
FIG. 5 is a view of the outer face of an exhaust rotor valve employed in the motor.

The exiting of spent fluid from cylinders 23 is under control of an exhaust rotor valve 41 at the exhaust face 19 of the cylinder block. Exhaust valve 41 is also mounted on and rotatable with an extension of crankshaft 22. As best shown in FIG. 5 exhaust rotor valve 41 has an outer arcuate slot 42 positioned to overlie exhaust ports 33 communicating with the outer ends of cylinders 23. The exhaust rotor valve 41 also has a second arcuate slot 43 positioned to overlie the exhaust ports 33 in communication with the inner ends of the cylinders 23. For balance the exhaust valve 41 may also have a third slot 44 formed therein.

Figure 7:
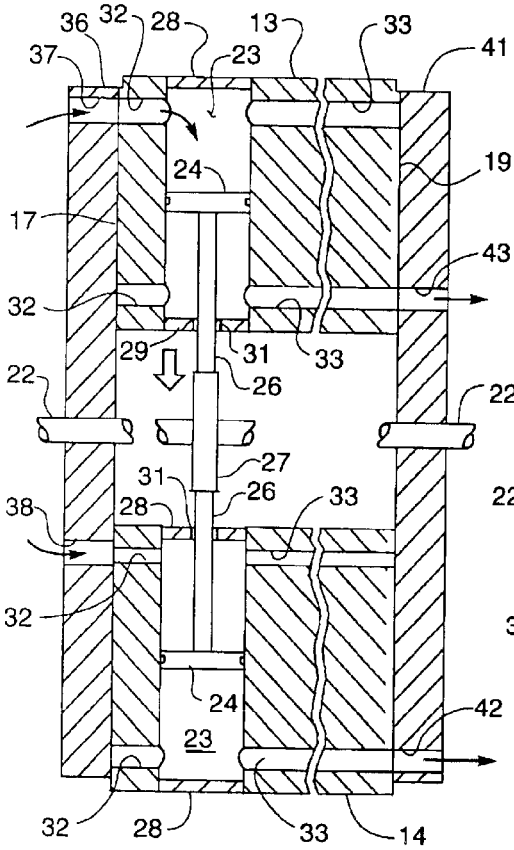
FIGS. 7 and 8 are sectional views illustrating diagrammatically operation of one set of pistons and cylinders.
Figure 8:
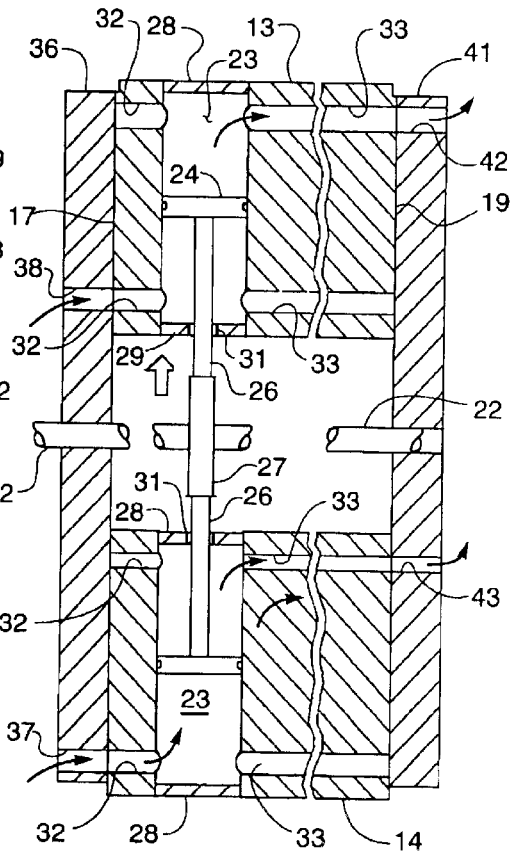

FIGS. 7 and 8 are sectional views illustrating diagramatically operation of one of the cylinder sets of the motor. Operation of the other two cylinder sets are identical to the one illustrated, but in sequence therewith because of the angular offset of the cylinder sets.

In both FIG. 7 and FIG. 8 the piston 24/connecting rod 26 assemblies are positioned in mid stroke. The direction in which the pistons are being driven by fluid pressure is indicated by the bold arrows—"down" in FIG. 7 and "up" in FIG. 8.

Referring particularly to FIG. 7 intake rotor valve 36 has been rotated by the crankshaft 22 to a position in which valve slot 37 overlies and opens inlet port 32 to the outer end of the upper cylinder directing pressurized fluid against the outer surface of the upper piston. In this same valve position valve slot 38 overlies and opens the inlet port 32 to the inner end of cylinder 23 directing pressurized fluid against the inner face of the lower piston 24. Thus, both pistons are being driven in the same direction.

Exhaust rotor valve 41 is positioned by the crankshaft so that it closes the exhaust ports 33 to the portions of both cylinders being pressurized and its slots 42 and 43 overlie and open exhaust ports 33 from the non-pressurized portions of the cylinders allowing the pistons 24 to move freely.

FIG. 8 shows the intake rotor valve 36 and the exhaust rotor valve 41 positioned for propelling both pistons 24 upwardly in about mid stroke.

Thus, the pistons 24 are driven in both stroke directions providing for a "push-push" operation of the cylinder sets.

Although not shown in FIGS. 7 and 8 it should be understood that pressurized fluid is presented to intake rotor valve 36 via the intake cover 16 and the spent exhaust fluid can he channeled through the exhaust cover 18, both of which are shown in FIGS. 1 and 2.

What is claimed is:

1. A fluid pressure actuated motor comprising:

a cylinder block having at least one set of opposed cylinders formed therein, said cylinder block further having a central axis midway between the cylinders and an intake face and an exhaust face at right angles to the axis, said block further having two intake ports for each cylinder formed therein and extending from the intake face of the block to opposite ends of each of the cylinders, said block further having two exhaust ports extending from opposite ends of each of the cylinders to the exhaust face of the block;

a piston reciprocable in each of the cylinders;

a crankshaft supported by the cylinder block and rotatable about the block axis, said crankshaft having portions extending beyond the faces of the block;

a connecting rod connected to each of said pistons and having a Scotch yoke connection to the crankshaft;

an intake rotor valve mounted on and rotating with the crankshaft extension at the intake face of the block;

an exhaust rotor valve mounted on and rotating with the crankshaft extension at the exhaust face of the block;

and means for introducing pressurized fluid to the intake rotor valve;

said intake rotor valve and said exhaust rotor valve cooperating to introduce pressurized fluid to and exhaust spent fluid from each of the cylinders of the set in a manner to drive both pistons in the set in the same direction during each stroke of the pistons.

2. The motor of claim 1 further characterized in that said intake rotor valve has arcuate slots therein positioned to selectively overlie the intake ports for the cylinders and the said exhaust rotor valve has arcuate slots therein positioned to selectively overlie the exhaust ports for the cylinders.

3. A motor as set forth in claim 1 having three sets of cylinders spaced along the axis of the cylinder block and radially offset by 120°.

4. The motor of claim 3 further characterized in that said intake rotor valve has arcuate slots therein positioned to selectively and sequentially overlie the intake ports for each of the three sets of cylinders and the said exhaust rotor valve has arcuate slots therein positioned to selectively and sequentially overlie the exhaust ports of the three sets of cylinders.

* * * * *